US011837213B2

(12) United States Patent
Pompei et al.

(10) Patent No.: US 11,837,213 B2
(45) Date of Patent: *Dec. 5, 2023

(54) ULTRASONIC TRANSDUCER WITH PERFORATED BASEPLATE

(71) Applicant: Holosonic Research Labs, Watertown, MA (US)

(72) Inventors: Frank Joseph Pompei, Wayland, MA (US); Xiang Yan, Waltham, MA (US)

(73) Assignee: Holosonic Research Labs, Watertown, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/738,360

(22) Filed: May 6, 2022

(65) Prior Publication Data

US 2022/0262335 A1 Aug. 18, 2022

Related U.S. Application Data

(63) Continuation of application No. 16/734,734, filed on Jan. 6, 2020, now Pat. No. 11,328,701.

(60) Provisional application No. 62/788,927, filed on Jan. 6, 2019.

(51) Int. Cl.
*G10K 9/12* (2006.01)
*G10K 13/00* (2006.01)

(52) U.S. Cl.
CPC ..... *G10K 9/12* (2013.01); *G10K 13/00* (2013.01)

(58) Field of Classification Search
CPC ..... G10K 9/12; G10K 13/00; G10K 9/18; G10K 15/02; H04R 2217/03; H04R 17/00
USPC ..... 367/189
See application file for complete search history.

(56) References Cited

U.S. PATENT DOCUMENTS

| | | | | |
|---|---|---|---|---|
| 9,686,618 | B2 | 6/2017 | Pompei | |
| 10,856,084 | B2 | 12/2020 | Pompei | |
| 10,991,359 | B2 | 4/2021 | Pompei | |
| 11,328,701 | B2 * | 5/2022 | Pompei | G10K 9/12 |
| 2014/0232236 | A1 | 8/2014 | Atkins et al. | |

FOREIGN PATENT DOCUMENTS

WO WO-2017053716 A1 * 3/2017 ..... B06B 1/0292

* cited by examiner

*Primary Examiner* — Daniel L Murphy
(74) *Attorney, Agent, or Firm* — BainwoodHuang

(57) ABSTRACT

An ultrasonic transducer including a membrane film and a perforated baseplate. The baseplate can have a conductive surface with a plurality of perforations formed through the baseplate. The membrane film can have a conductive surface and be positioned under tension proximate to the perforations formed through the baseplate. The tension of the membrane film can be controlled to provide a restoring force to counteract the moving mass of the membrane film, and the moving mass of air in the perforations of the baseplate. By selecting the diameter(s) of the perforations of the baseplate, the thickness of the baseplate, the thickness of the membrane film, the tension of the membrane film, and/or the bending stiffness of the membrane film, a wide bandpass frequency response of the ultrasonic transducer centered at an ultrasonic frequency of interest can be obtained and tailored to a desired application.

18 Claims, 6 Drawing Sheets

ULTRASONIC TRANSDUCER WITH PERFORATED BASEPLATE

CROSS-REFERENCE TO RELATED APPLICATIONS

This application is a continuation of U.S. patent application Ser. No. 16/734,734 filed Jan. 6, 2020 entitled ULTRASONIC TRANSDUCER WITH PERFORATED BASEPLATE, which claims benefit of the priority of U.S. Provisional Patent Application No. 62/788,927 filed Jan. 6, 2019 entitled ULTRASONIC TRANSDUCER.

BACKGROUND

Ultrasonic transducers are known that include a conductive metal backplate and a metalized polymer membrane film. The backplate has a plurality of depressions (e.g., a series of grooves) formed in its surface that partially penetrate the backplate. The respective depressions are configured to facilitate vibrational motion of the membrane film by trapping or restricting air, which compresses and expands as the membrane film moves. The trapped or restricted air acts as an acoustic compliance or "spring," providing a restoring force against the membrane film. Characteristics of the respective depressions, including their depth, spacing, and shape, in combination with material properties of the membrane film determine the dynamics of the membrane film's vibrational motion. Such ultrasonic transducers are known as Sell-type transducers, which have long been used in industry.

SUMMARY

In accordance with the present disclosure, an ultrasonic transducer is disclosed that includes a membrane film and a perforated baseplate. The perforated baseplate can have a conductive surface with a plurality of apertures, openings, or perforations formed on and/or through the baseplate. The membrane film can have a conductive surface, and can be positioned under tension adjacent, proximate to, or in contact with the apertures, openings, or perforations formed on and/or through the perforated baseplate. By applying a voltage between the conductive surface of the baseplate and the conductive surface of the membrane film, an electrical force of attraction can be created between the baseplate and the membrane film. Varying this applied voltage can cause the membrane film to undergo vibrational motion.

In the disclosed ultrasonic transducer, the tension of the membrane film can be controlled to provide a restoring force to counteract the moving mass of the membrane film, as well as the moving mass of air disposed in the apertures, openings, or perforations of the baseplate. By selecting the sizes of the apertures, openings, or perforations of the baseplate, the thickness of the baseplate, the thickness of the membrane film, the tension of the membrane film, and/or the bending stiffness of the membrane film, a wide bandpass frequency response of the ultrasonic transducer centered at an ultrasonic frequency of interest can be obtained and tailored to a desired application.

In certain embodiments, an ultrasonic transducer includes a baseplate having a plurality of perforations formed therethrough. The plurality of perforations have a predetermined configuration or characteristic associated therewith. The predetermined configuration or characteristic of the respective perforations is configured to determine one or more of a frequency response and a spatial response of the ultrasonic transducer. The ultrasonic transducer further includes a vibrator layer placed adjacent, proximate to, or in contact with the plurality of perforations of the baseplate.

In certain arrangements, the vibrator layer includes a membrane film having a conductive surface.

In certain arrangements, the baseplate includes a conductive surface.

In certain arrangements, the ultrasonic transducer includes a DC bias voltage source connected across the conductive surface of the vibrator layer and the conductive surface of the baseplate.

In certain arrangements, the ultrasonic transducer includes a cover, a tension component, and at least one resilient member. The resilient member is operatively attached between the cover and the tension component. The resilient member is configured to press downward upon and to urge the tension component against the vibrator layer to provide a consistent and/or persistent lateral tension to the vibrator layer.

In certain arrangements, the ultrasonic transducer includes a frame having a recess. The resilient member is configured to displace the vibrator layer into the recess of the frame.

In certain arrangements, the cover is configured to be fastened to the frame, thereby causing the at least one resilient member to be compressed for generating a force to urge the tension component against the vibrator layer and to engage the vibrator layer onto the baseplate.

In certain arrangements, an overall shape of the baseplate and the vibrator layer in contact with the baseplate is curved for focusing or acoustic field shaping purposes.

In certain arrangements, the predetermined characteristic of the respective perforations corresponds to one or more of a size, a diameter, physical distribution, and a shape of the respective perforations.

In certain embodiments, a phased array driver or receiver includes a printed circuit board (PCB) having a plurality of perforations formed therethrough. The respective perforations are configured as one or more of a via and a through-hole pad formed in the PCB. Each of the respective perforations or each of a plurality of groups of the respective perforations corresponds to an individual phased array element of the phased array driver or receiver. The phased array driver or receiver further includes a vibrator layer placed in contact with one or more of the respective perforations and the groups of the respective perforations of the PCB.

In certain arrangements, the vibrator layer includes a membrane film with a conductive surface.

In certain arrangements, a DC bias voltage is applied to the respective phased array elements and the conductive surface of the vibrator layer is grounded.

In certain arrangements, a DC bias voltage is applied to the conductive surface of the vibrator layer and drive signals are applied to the respective phased array elements.

In certain arrangements, the PCB is a flexible PCB configured to be contoured for focusing the phased array driver or receiver.

In certain embodiments, a method of fabricating an ultrasonic transducer includes forming a plurality of perforations having a predetermined configuration or characteristic through a baseplate of the ultrasonic transducer. The predetermined configuration or characteristic of the respective perforations determines one or more of a frequency response and a spatial response of the ultrasonic transducer. The method further includes placing a vibrator layer in contact with the plurality of perforations of the baseplate of the ultrasonic transducer.

In certain arrangements, the method includes attaching the vibrator layer to a frame, and fastening a cover to the frame to enclose the baseplate and the vibrator layer.

In certain arrangements, the method includes placing a tension component between the cover and the frame, and connecting at least one resilient member between the cover and the tension component. The cover is configured to cause the at least one resilient member to be compressed for generating a force to urge the tension component against the vibrator layer and to engage the vibrator layer onto the baseplate.

In certain arrangements, the method includes connecting a DC bias voltage source across a conductive surface of the vibrator layer and a conductive surface of the baseplate.

In certain arrangements, the method includes curving the baseplate to form one of a spherical shape and a cylindrical shape to alter a beam geometry produced by the ultrasonic transducer.

Other features, functions, and aspects of the present disclosure will be evident from the Detailed Description that follows.

BRIEF DESCRIPTION OF THE DRAWINGS

The foregoing and other objects, features, and advantages will be apparent from the following description of particular embodiments of the present disclosure, as illustrated in the accompanying drawings in which like reference characters refer to the same parts throughout the different views.

DETAILED DESCRIPTION

The disclosures of U.S. patent application Ser. No. 16/734,734 filed Jan. 6, 2020 entitled ULTRASONIC TRANSDUCER WITH PERFORATED BASEPLATE and U.S. Provisional Patent Application No. 62/788,927 filed Jan. 6, 2019 entitled ULTRASONIC TRANSDUCER are hereby incorporated herein by reference in their entirety.

An ultrasonic transducer is disclosed that includes a membrane film and a perforated baseplate. The perforated baseplate can have a conductive surface with a plurality of apertures, openings, or perforations formed on and/or through the baseplate. The membrane film can have a conductive surface, and can be positioned under tension adjacent, proximate to, or in contact with the apertures, openings, or perforations formed on and/or through the perforated baseplate. The tension of the membrane film can be controlled to provide a restoring force to counteract the moving mass of the membrane film, as well as the moving mass of air disposed in the apertures, openings, or perforations of the baseplate. By selecting the sizes of the apertures, openings, or perforations of the baseplate, the thickness of the baseplate, the thickness of the membrane film, the tension of the membrane film, and/or the bending stiffness of the membrane film, a wide bandpass frequency response of the ultrasonic transducer centered at an ultrasonic frequency of interest can be obtained and tailored to a desired application.

Figure 1A:
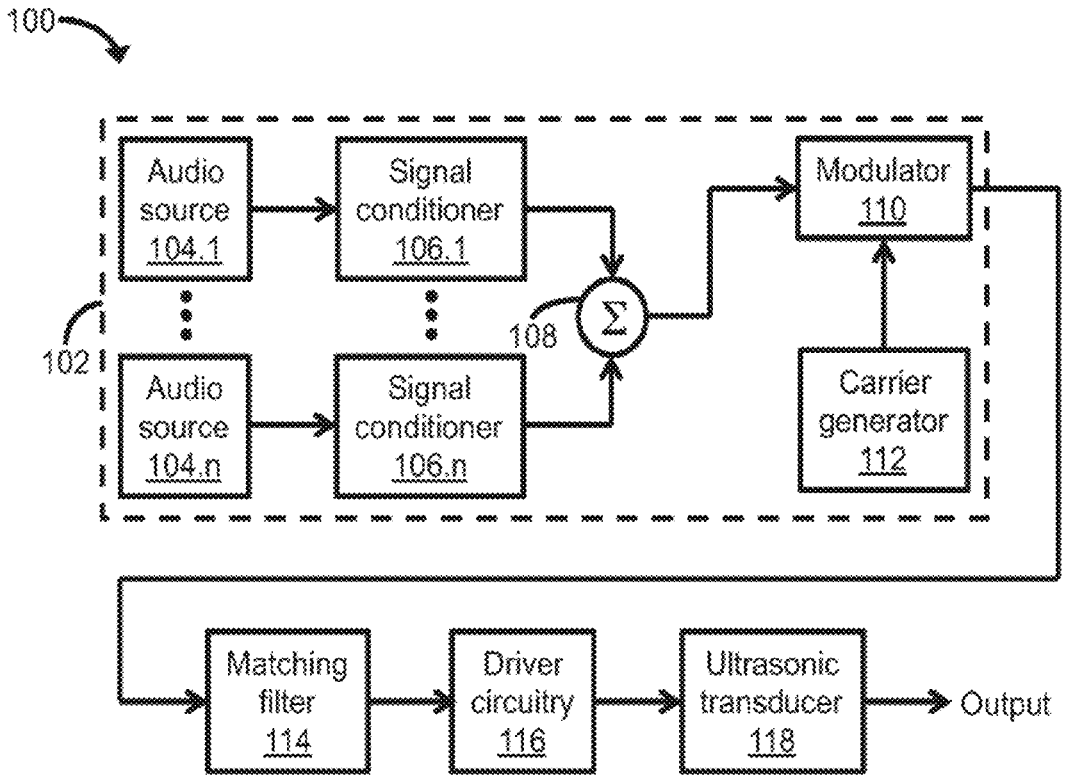
FIG. 1*a* is a block diagram of a parametric audio system that includes an exemplary ultrasonic transducer.

FIG. 1*a* depicts an illustrative embodiment of a parametric audio system 100, which includes an exemplary ultrasonic transducer 118. As shown in FIG. 1*a*, the parametric audio system 100 can include a signal generator 102, a matching filter 114, driver circuitry 116, and the ultrasonic transducer 118. The signal generator 102 can include a plurality of audio sources 104.1-104.*n*, a plurality of signal conditioners 106.1-106.*n*, summing circuitry 108, a modulator 110, and a carrier generator 112. In an exemplary mode of operation, the audio sources 104.1-104.*n* can generate a plurality of audio signals, respectively. The plurality of signal conditioners 106.1-106.*n* can receive the plurality of audio signals, respectively, perform signal conditioning on the respective audio signals, and provide the conditioned audio signals to the summing circuitry 108. In certain implementations, the plurality of signal conditioners 106.1-106.*n* can each be configured to include nonlinear inversion circuitry for reducing or substantially eliminating any unwanted distortion in audio that might be reproduced from an output of the parametric audio system 100. The plurality of signal conditioners 106.1-106.*n* can each further include equalization circuitry, compression circuitry, and/or any other suitable signal conditioning circuitry. It is noted that such signal conditioning of the plurality of audio signals can alternatively be performed after the audio signals are summed by the summing circuitry 108.

The summing circuitry 108 can be configured to sum the conditioned audio signals and provide a composite audio signal to the modulator 110. The carrier generator 112 can be configured to generate an ultrasonic carrier signal and provide the ultrasonic carrier signal to the modulator 110. The modulator 110 can be configured to modulate the ultrasonic carrier signal with the composite audio signal. For example, the modulator 110 can be configured to perform amplitude modulation by multiplying the composite audio signal with the ultrasonic carrier signal, or by any other suitable form of modulation for converting audio-band signal(s) to ultrasound. Having modulated the ultrasonic carrier signal with the composite audio signal, the modulator 110 can provide the modulated signal to the matching filter 114. The matching filter 114 can be configured to compensate for any unwanted distortion resulting from a non-flat frequency response of the driver circuitry 116 and/or the ultrasonic transducer 118.

The driver circuitry 116 can be configured to receive the modulated ultrasonic carrier signal from the matching filter 114 and provide an amplified version of the modulated ultrasonic carrier signal to the ultrasonic transducer 118, which can emit from its output at high intensity the amplified/modulated ultrasonic carrier signal as an ultrasonic beam. In certain implementations, the driver circuitry 116 can be configured to include one or more delay circuits (not shown) for applying a relative phase shift across frequencies and multiple output channels of the modulated ultrasonic carrier signal sent to multiple transducers or transducer elements to steer, focus, and/or shape the ultrasonic beam emitted by the ultrasonic transducer 118. Once emitted from the output of the ultrasonic transducer 118, the ultrasonic beam can be demodulated as it passes through the air or any other suitable propagation medium, due to nonlinear propagation characteristics of the air or other suitable propagation medium. Having demodulated the ultrasonic beam, audible sound can be produced.

Figure 1B:
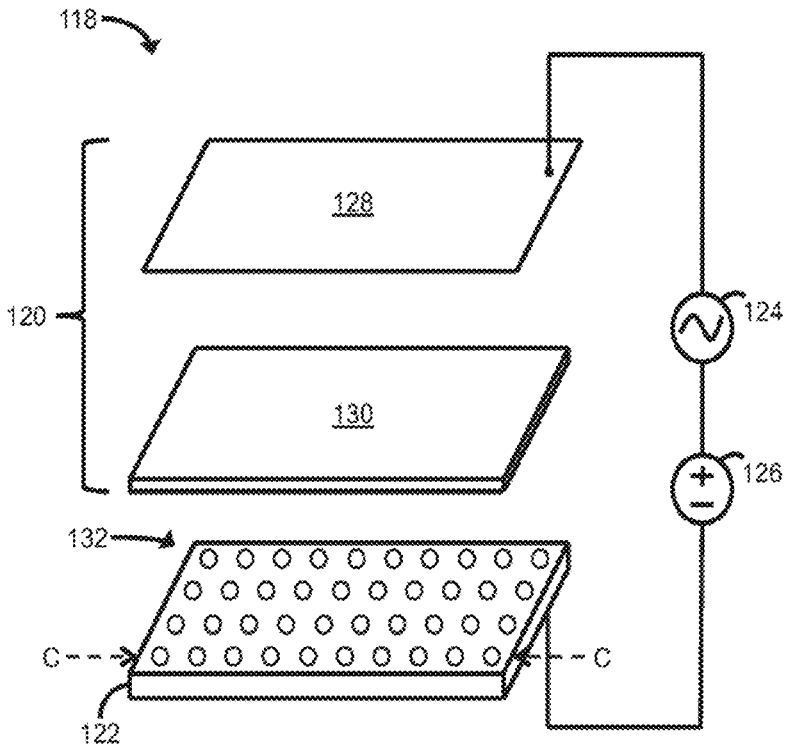
FIG. 1*b* is an exploded perspective view of a portion of the ultrasonic transducer of FIG. 1*a;*

FIG. 1*b* depicts an exploded perspective view of a portion of the ultrasonic transducer 118 of FIG. 1*a*. As shown in FIG. 1*b*, the ultrasonic transducer 118 can include a vibrator layer 120 and a perforated baseplate 132. The vibrator layer 120 can include a membrane film 130 having a conductive surface 128. For example, the membrane film 130 can be implemented with a thin (e.g., about 0.2-100.0 μm or 0.008-3.937 mil, typically about 8 μm or 0.315 mil) polyester film, polyimide film, polyvinylidene fluoride (PVDF) film, polyethylene terephthalate (PET) film, polytetrafluoroethylene (PTFE) film, or any other suitable polymeric or non-polymeric film. The conductive surface 128 of the membrane film 130 can be implemented with a coating of aluminum, gold, nickel, or any other suitable conductive material. The perforated baseplate 132 can include a plurality of apertures, openings, or perforations formed thereon and/or therethrough. For example, the plurality of apertures, openings, or perforations can be formed on and/or through the perforated baseplate 132 by an etching process, a molding process, an embossing process, a punching process, or any other suitable process. Further, the perforated baseplate 132 can be made of aluminum, steel, stainless steel, plastic, or any other suitable material. The perforated baseplate 132 can also be coated with aluminum or any other suitable conductive material. The plurality of apertures, openings, or perforations formed on and/or through the perforated baseplate 132 can be circular, elongated, slotted, square, oval, oblong, hexagonal, or any other suitable shape.

As shown in FIG. 1*b*, a DC bias voltage source 126 (e.g., 300 $V_{DC}$) can be connected across the conductive surface 128 of the membrane film 130 and a conductive surface 122 of the baseplate 132. The DC bias voltage source 126 can increase the sensitivity and/or output capability of the ultrasonic transducer 118, as well as reduce any unwanted distortion in the ultrasonic beam emitted by the ultrasonic transducer 118. In certain implementations, the membrane film 130 can have electret properties, allowing the vibrator layer 120 to function as a DC bias source in place of the DC bias voltage source 126. It is noted that, in FIG. 1*b*, the amplified, modulated ultrasonic carrier signal provided to the ultrasonic transducer 118 by the driver circuitry 116 is represented by a time-varying signal generated by an AC signal source 124, which is connected with the DC bias voltage source 126 such that the voltage delivered to the ultrasonic transducer 118 is the sum of DC and AC voltage components. In certain implementations, a large resistor can be employed to feed the DC bias voltage to the ultrasonic transducer while blocking the AC signal, and a large capacitor can be employed for coupling in the AC signal and blocking the AC signal from the DC bias voltage source.

Figure 1C:
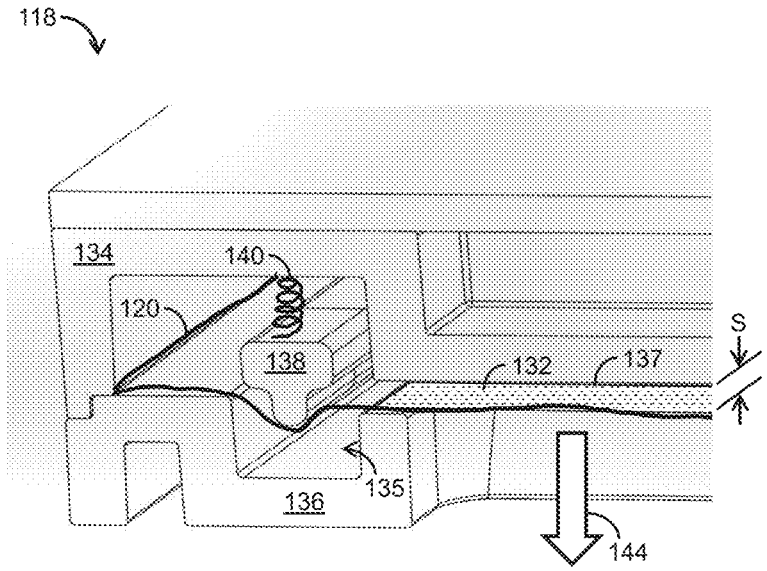
FIG. 1*c* is a perspective view of another portion of the ultrasonic transducer of FIG. 1*a;*

FIG. 1*c* depicts a perspective view of another portion of the ultrasonic transducer 118 of FIG. 1*a*. As shown in FIG. 1*c*, the ultrasonic transducer 118 can further include a cover 134, a frame 136, a tension component 138, and at least one resilient member 140 such as a spring operatively attached between the cover 134 and the tension component 138. The perforated baseplate 132 can be disposed between the frame 136 and the vibrator layer 120. It is noted that the vibrator layer 120 is depicted in FIG. 1*c* as being transparent to allow the perforated baseplate 132 to be visible. In certain implementations, the vibrator layer 120 can be placed on top of the perforated baseplate 132 and securely attached or anchored to sides of the frame 136. The resilient member(s) 140 are configured to press downward upon and urge the tension component 138 against the vibrator layer 120, displacing the vibrator layer 120 into a recess 135 of the frame 136. The tension component 138 and resilient member(s) 140 are configured to provide a consistent and/or persistent lateral tension to the vibrator layer 120 over time and under changing pressure, temperature, and/or other environmental condition(s). It is noted that any other suitable structure can be employed for providing spring-loaded tension to the vibrator layer 120. For example, the ultrasonic transducer 118 can include one or more springs configured to push a moving element that tensions the vibrator layer 120 laterally. The ultrasonic transducer 118 can also include one or more springs configured to push the perforated baseplate 132 toward the vibrator layer 120 to apply the desired tension.

The cover 134 is configured to enhance the output of the ultrasonic transducer 118, as well as protect its overall assembly. The cover 134 can be fastened to the frame 136, causing the resilient member(s) 140 to be compressed for generating a force to urge the tension component 138 against the vibrator layer 120 and engage the vibrator layer 120 onto the perforated baseplate 132. In certain implementations, the cover 134 can be placed in close proximity to the vibrator layer 120. Further, a spacing, S (see FIG. 1*c*), between the cover 134 and the vibrator layer 120 can be determined (e.g., empirically determined by measuring) to enhance the sensitivity, bandwidth, and/or total output of the ultrasonic transducer 118. In certain implementations, the portion of the cover 134 that faces the baseplate 132 can include a solid flat surface portion 137. It is noted that the flat surface portion 137 of the cover 134 that opposes the apertures, openings, or perforations of the perforated baseplate 132 can act as a reflecting surface and can be optimally spaced from the vibrator layer 120 by the spacing, S, for enhanced transducer sensitivity, bandwidth, and/or total output.

In certain implementations, the perforated baseplate 132 can act as a grille, which can be configured to optimize radiation impedance matching between the vibrator layer 120 and the air. The perforated baseplate 132 can also provide protection for the vibrator layer 120 and other interior structures of the ultrasonic transducer 118, potentially saving costs while simplifying assembly. In certain implementations, the acoustic radiation (or reception) can be on the side of the membrane film rather than on the side of the perforated baseplate 132. This can be implemented by disposing the vibrator layer 120 between the frame 136 and the perforated baseplate 132. In such implementations, a secondary grille (not shown) can be employed to provide added protection for the vibrator layer 120. In addition, an optional fabric layer (not shown) can be included for aesthetic purposes.

In certain implementations, the conductive surface 122 of the perforated baseplate 132 can act as a first electrode while the conductive surface 128 of the vibrator layer 120 acts as a second electrode. Applying a voltage between the first and second electrodes of the conductive surfaces 122, 128, respectively, can create an attractive force, and applying a time-varying voltage between the first and second electrodes can cause the vibrator layer 120 to vibrate, creating soundwaves that pass through the apertures, openings, or perforations of the perforated baseplate 132, as illustrated by a directional arrow 144 (see FIG. 1*c*).

Figure 1D:
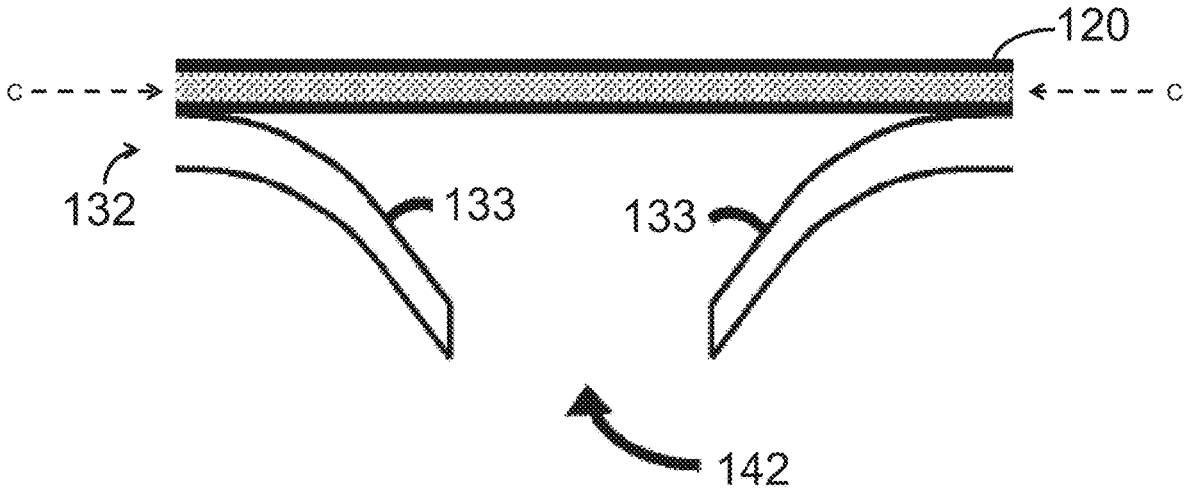
FIG. 1*d* is a partial cross-sectional view of a perforated baseplate and vibrator layer included in the ultrasonic transducer of FIG. 1*a;*

FIG. 1*d* depicts a partial cross-sectional view (corresponding to reference lines C; see also FIG. 1*b*) of the perforated baseplate 132 and vibrator layer 120 of the ultrasonic transducer 118 of FIG. 1*a*. As shown in FIG. 1*d*, the perforated baseplate 132 includes a surface 133 with a plurality of apertures, openings, or perforations formed thereon and/or therethrough, as partially illustrated by an exemplary perforation 142. The vibrator layer 120 can be placed adjacent, proximate to, or in contact with the apertures, openings, or perforations (e.g., the perforation 142) formed on and/or through the perforated baseplate 304. When the vibrator layer 120 is in contact with the perforated baseplate 304, the membrane film can bend into the respective perforations, which can act like drums that resonate at ultrasound frequencies.

In certain implementations, the apertures, openings, or perforations, such as the perforation 142 of FIG. 1*d*, can be formed to include tapered sides 133 that gradually transition from substantially horizontal (near the vibrator layer 120) to almost vertical before reaching an opening of the perforation 142. In certain implementations, the tapered sides 133 can have a slope (or a varying slope) that approaches zero adjacent the vibrator layer 120 and curves downward toward the opening of the perforation 142. In certain implementations, the tapered sides 133 can include slanted ramp portions having one or more slanted ramp sections. In each such implementation, the spacing between the surface 133 of the perforated baseplate 132 and the vibrator layer 120 increases toward the opening of the perforation 142.

The sizes of the apertures, openings, or perforations (such as the perforation 142; see FIG. 1*d*) can be selected, in combination with characteristics of the vibrator layer 120 and/or the tension of the vibrator layer 120, to optimize the performance of the ultrasonic transducer 118 at a desired frequency range. For example, larger sizes can be employed to optimize at lower frequencies, while smaller sizes can be employed to optimize at higher frequencies. In certain implementations, the sizes of the apertures, openings, or perforations of the perforated baseplate 132 can correspond to the fundamental, lowest frequency mode of vibration of the vibrator layer 120, which is disposed adjacent, proximate to, or in contact with the perforated baseplate 132. In certain implementations, configurations (e.g., curved, circular, linear configurations) and/or characteristics (e.g., sizes, diameters, shapes) of the apertures, openings, or perforations can be uniform across the perforated baseplate 132, or can vary to tailor the frequency response and/or the spatial response, and/or increase the bandwidth of the ultrasonic transducer 118. In certain implementations, more than one type or combination of types of apertures, openings, or perforations can be formed in the perforated baseplate 132 to tailor the frequency and/or spatial response of the ultrasonic transducer 118. In certain implementations, a uniform or non-uniform configuration, pattern, or distribution of the apertures, openings, or perforations can be employed to determine the spatial properties of the ultrasound field, as well as the frequency response. In certain implementations, a tight staggered pattern of the apertures, openings, or perforations can be employed to maximize the density of the perforations. It is noted that the ultrasonic transducer 118 can be configured for use as a transmitter or a receiver, and can be employed as a general purpose ultrasonic transducer for haptic, ranging, reception, industrial, and/or any other suitable purpose.

Having described the above illustrative embodiment of the disclosed ultrasonic transducer, alternative embodiments and/or variations of the ultrasonic transducer can be made and/or practiced. As an alternative (or addition) to the above-described illustrative embodiment, the ultrasonic transducer 118 can be configured to create a phased array driver (or receiver). In such a configuration, single apertures, openings, or perforations of the perforated baseplate 132 (or groups of such apertures, openings, or perforations) can be formed as individual elements. Further, the vibrator layer 120 can be patterned to isolate certain areas of the perforated baseplate 132 for different drive signals, and/or the apertures, openings, or perforations can be addressed individually (or in small groups) as elements of the phased array driver (or receiver). The vibrator layer 120 can maintain a single voltage (e.g., ground or DC bias only), while each aperture, opening, or perforation (or group of such apertures, openings, or perforations) receives a different drive signal.

Figure 2:
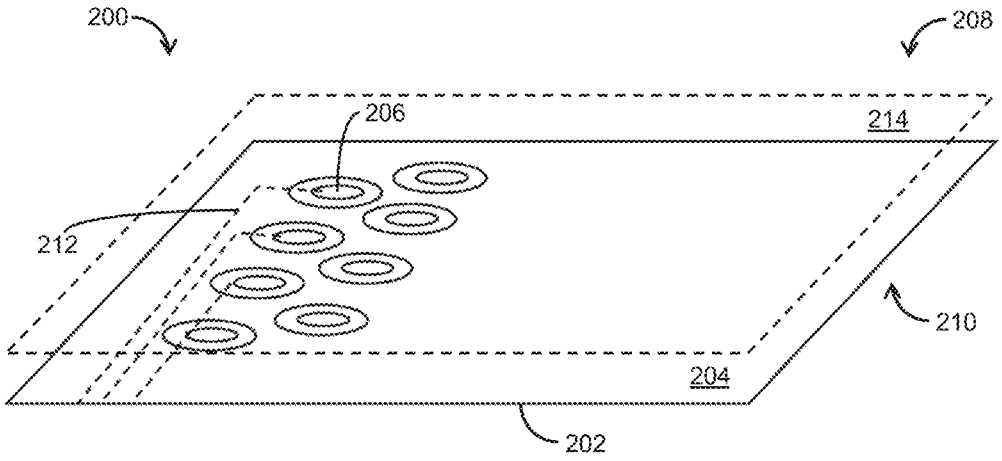
FIG. 2 is a diagram of an exemplary phased array driver (or receiver), which includes a printed circuit board (PCB) configured as a perforated baseplate.

FIG. 2 depicts an illustrative embodiment of a phased array driver (or receiver) 200, which includes a printed circuit board (PCB) 202 configured as a perforated PCB, and a vibrator layer 214 (shown in phantom for clarity of illustration). As shown in FIG. 2, the PCB 202 includes a plurality of apertures, openings, or perforations, each of which can be configured as a via or through-hole pad (such as a via or through-hole pad 206; see FIG. 2). The respective vias or through-hole pads of the PCB 202 can be individually electrically addressed using any layer of the PCB 202 (including internal layers). Further, drive circuitry can be placed on a far side 210 of the PCB 202 (opposite of a film side 208 of the PCB 202) for convenience and/or tight integration. It is noted that a surface 204 of the PCB 202 can be formed with pressure using any suitable tooling, or an additional material or component can be added to the film side 208 of the PCB 202 to provide suitable surface geometries for the respective vias or through-hole pads. In certain implementations, the vibrator layer 214 can be fastened to the surface 204 in contact with the respective vias or through-hole pads of the PCB 202, preventing neighboring vias or through-hole pads from influencing one another. Alternatively (or in addition), electrodes can be disposed between neighboring vias or through-hole pads (e.g., with a DC bias) to create a strong electrical force of attraction that holds the membrane film stationary between the respective elements.

As shown in FIG. 2, the phased array driver (or receiver) 200 can include an assortment of vias or through-hole pads (such as the via or through-hole pad 206), which can be configured as phased array elements. Each respective via or through-hole pad can have a separate electrical connection (such as an electrical connection 212), which can be formed on any suitable layer of the PCB 202. In certain implementations, flexible circuitry can be employed for contouring the phased array driver (or receiver) 200 as desired and/or required, such as for focusing purposes. In certain implementations, multiple vias or through-hole pads can be grouped and driven (or sensed) together, thereby creating phased array elements that are larger than the individual vias or through-hole pads. In certain implementations, a DC bias can be applied to the membrane film (or vibrator layer) with an AC drive signal applied to each of the phased array elements. Alternatively (or in addition), a DC bias and an AC drive signal can be applied to each of the phased array elements and the membrane film can be grounded. A series of large-valued resistors can also be used to carry the DC bias to each phased array element, thereby causing the DC charging rate to be slower than the drive signal rate and isolating the drive signals between respective elements.

It is noted that, for non-phased array use, either the vibrator layer 214 or the conductive surfaces of the perforations can be grounded, connected to a DC bias, or connected to an AC signal, in any suitable combination. A non-phased array system can also be contoured for focusing or other similar purposes. It is further noted that the elements of the phased array driver (or receiver) 200 can be grouped in any desired formation or configuration on the PCB 202.

For example, the phased array elements can be grouped in a circular array configuration for Fresnel-like focusing, a linear array configuration, or any other suitable formation or configuration.

Figure 3:
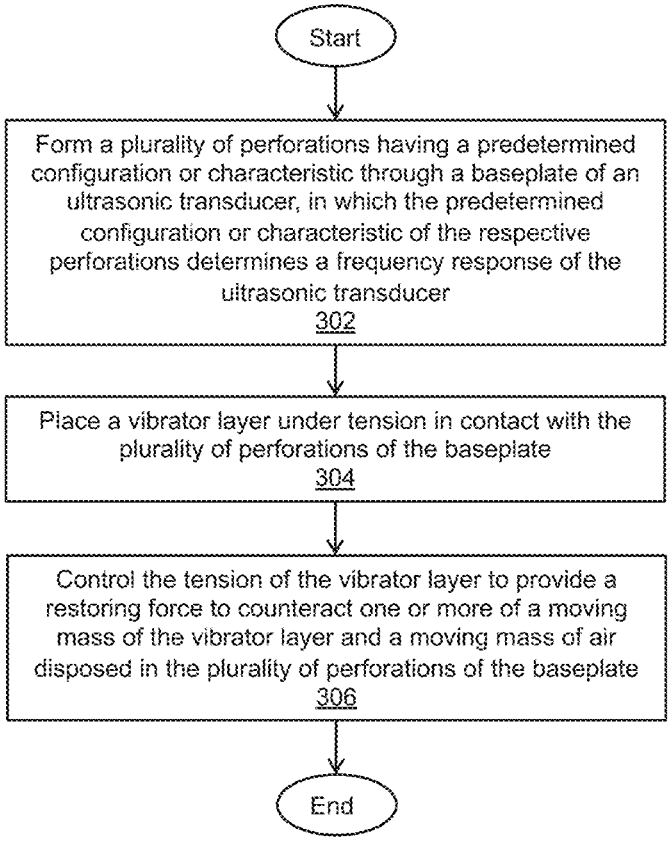
FIG. 3 is a flow diagram of an exemplary method of fabricating the ultrasonic transducer of FIG. 1*a*.

A method of fabricating an ultrasonic transducer is described below with reference to FIG. 3. As depicted in block 302, a plurality of perforations having a predetermined configuration or characteristic are formed through a baseplate of the ultrasonic transducer, in which the predetermined configuration or characteristic of the respective perforations determines a frequency response of the ultrasonic transducer. As depicted in block 304, a vibrator layer is placed under tension in contact with the plurality of perforations of the baseplate. As depicted in block 306, the tension of the vibrator layer is controlled to provide a restoring force to counteract one or more of a moving mass of the vibrator layer and a moving mass of air disposed in the plurality of perforations of the baseplate.

While various embodiments of the present disclosure have been particularly shown and described, it will be understood by those skilled in the art that various changes in form and details may be made therein without departing from the scope of the present disclosure, as defined by the appended claims.

What is claimed is:

1. An ultrasonic transducer comprising:

a baseplate having a plurality of perforations formed therethrough; and a vibrator layer positioned adjacent, proximate to, or in contact with the plurality of perforations, wherein an overall shape of the baseplate is curved for field shaping purposes.

2. The ultrasonic transducer of claim 1 wherein each perforation includes tapered sides that gradually transition from substantially horizontal near the vibrator layer to substantially vertical before reaching an opening of the perforation.

3. The ultrasonic transducer of claim 1 wherein the vibrator layer is positioned under a consistent and/or persistent tension adjacent, proximate to, or in contact with the plurality of perforations.

4. The ultrasonic transducer of claim 1 wherein the vibrator layer includes a membrane film having a conductive surface.

5. The ultrasonic transducer of claim 4 wherein the baseplate includes a conductive surface.

6. The ultrasonic transducer of claim 5 further comprising:

a DC bias voltage source connected across the conductive surface of the vibrator layer and the conductive surface of the baseplate.

7. The ultrasonic transducer of claim 1 further comprising:

a surface of reflection positioned on a side of the baseplate opposite a direction of sound propagation, wherein the surface of reflection is spaced at a predetermined distance from the vibrator layer to optimize transducer output or sensitivity.

8. The ultrasonic transducer of claim 1 further comprising:

a frame having a recess, wherein the vibrator layer is displaced into the recess of the frame.

9. An ultrasonic transducer, comprising:

a printed circuit board (PCB) having one or more perforations formed therethrough, wherein the one or more perforations correspond to one or more individual ultrasonic transducer elements; and a vibrator layer placed adjacent, proximate to, or in contact with the one or more perforations.

10. The ultrasonic transducer of claim 9 wherein the vibrator layer includes a conductive surface, wherein a DC bias voltage is applied to the one or more perforations, and wherein the conductive surface of the vibrator layer is grounded.

11. The ultrasonic transducer of claim 9 wherein the vibrator layer includes a conductive surface, and wherein a DC bias voltage is applied to the conductive surface of the vibrator layer.

12. The ultrasonic transducer of claim 9 wherein the PCB is a flexible PCB configured to be contoured for focusing or acoustic field shaping purposes.

13. The ultrasonic transducer of claim 9 wherein the PCB has a plurality of perforations formed therethrough, wherein the respective perforations or group of perforations each correspond to individual ultrasonic transducer elements.

14. The ultrasonic transducer of claim 13 wherein each individual ultrasonic transducer element has a conductive surface connected to a respective one of a plurality of AC drive signals.

15. The ultrasonic transducer of claim 14 wherein the vibrator layer has a nonconductive surface adjacent, proximate to, or in contact with the one or more individual ultrasonic transducer elements and a conductive surface opposite the nonconductive surface, and wherein the vibrator layer is connected to a DC bias voltage.

16. A method of fabricating an ultrasonic transducer, comprising:

forming a plurality of perforations through a baseplate of the ultrasonic transducer;

positioning a vibrator layer adjacent, proximate to, or in contact with the plurality of perforations; and curving the baseplate to alter a beam geometry produced by the ultrasonic transducer.

17. The method of claim 16 wherein the positioning of the vibrator layer includes positioning the vibrator layer under a consistent and/or persistent tension adjacent, proximate to, or in contact with the plurality of perforations.

18. The method of claim 16 further comprising:

connecting a DC bias voltage source across a conductive surface of the vibrator layer and a conductive surface of the baseplate.

* * * * *